US007182105B1

(12) United States Patent
Feehan et al.

(10) Patent No.: US 7,182,105 B1
(45) Date of Patent: Feb. 27, 2007

(54) AUTOMATED SOLID PHARMACEUTICAL PACKAGING MACHINE UTILIZING ROBOTIC DRIVE

(75) Inventors: Jeff Feehan, Trinity, FL (US); Robert Barrett, St. Pete Beach, FL (US)

(73) Assignee: MTS Medication Technologies, Inc., St. Petersburg, FL (US)

( * ) Notice: Subject to any disclaimer, the term of this patent is extended or adjusted under 35 U.S.C. 154(b) by 0 days.

(21) Appl. No.: 11/269,781

(22) Filed: Nov. 8, 2005

(51) Int. Cl.
*B65B 1/04* (2006.01)

(52) U.S. Cl. ..... 141/2; 141/18; 141/98; 700/231; 53/473

(58) Field of Classification Search ..... 141/2, 141/18, 98, 104, 67, 129; 53/473; 700/231; 221/2–9
See application file for complete search history.

(56) References Cited

U.S. PATENT DOCUMENTS 5,771,657 A * 6/1998 Lasher et al. ..... 53/55
6,006,946 A * 12/1999 Williams et al. ..... 221/9
6,036,812 A * 3/2000 Williams et al. ..... 156/277
7,006,893 B2 * 2/2006 Hart et al. ..... 700/235

* cited by examiner

*Primary Examiner*—Steven O. Douglas
(74) *Attorney, Agent, or Firm*—Robert J. Depke; Rockey, Depke, Lyons & Kitzinger LLC.

(57) ABSTRACT

A machine for packaging solid pharmaceuticals includes a plurality of storage locations for storing a variety of pharmaceutical dispensing canisters and a robotic arm for retrieving said dispensing canisters and providing the canister at a location proximate the package to be filled thus minimizing the distance which the pharmaceutical travels from the dispensing canister and the package cavity.

11 Claims, 6 Drawing Sheets

AUTOMATED SOLID PHARMACEUTICAL PACKAGING MACHINE UTILIZING ROBOTIC DRIVE

BACKGROUND OF THE INVENTION

This invention is generally directed to an automated pharmaceutical packaging machine. There are currently a wide variety of automated pharmaceutical packaging machines available. The majority of these machines are designed for packaging a single pharmaceutical product into pharmaceutical packages. These machines are typically used in connection with pharmaceutical packages which include a plurality of cavities each designed to house a single pharmaceutical dose. The cavities are filled by inserting a pharmaceutical dose into each cavity and then adhesively applying a backing to the sheet of cavities to seal the solid pharmaceuticals within the cavities. These automated machines satisfy the majority of solid pharmaceutical packaging requirements where a single type of product is inserted into the package cavities. However, especially in managed-care facilities, there's a significant need for an automated pharmaceutical packaging machine which is capable of selectively depositing one or more pharmaceuticals into each of the individual cavities in a pharmaceutical product package.

Managed-care facilities now use patient specific packaging that provides all of the patients prescription drug needs for a given period of time. Existing packaging solutions typically employ solid pharmaceutical product package cards that contain all the given patient's dosages for a one-week period of time. Each dose of one or more pharmaceuticals is stored in a clear plastic cavity. Thus, for a given dosage time, a patient's required medication typically may require as many as three to four different clear plastic cavities. As a result, it is necessary that the managed-care facility go through more time-consuming process in order to assemble the patient's doses of solid pharmaceuticals for given period of time.

Applicant has invented an automated system and method for selectively filling a plurality of different dosing cavities with a plurality of different solid pharmaceutical medications for a single patient. Applicant's system is described in U.S. patent application Ser. No. 09/539,834. In general, the method provides for the filling of a product package have a plurality of cavities arranged in an array. A number of canisters, each containing a different type of drug, are positioned above the package cavities. The canisters are typically arranged in an array. The canisters dispense solid pharmaceuticals through a feed mechanism into the cavities as the cavities are selectively positioned beneath the feed mechanism. The system relies on gravitational forces to carry the pharmaceuticals through the feed mechanism. Generally a large number of different types of pharmaceuticals are needed to meet patient requirements. Therefore, the array of canisters is large and a large feed mechanism is needed to receive the pharmaceuticals from the entire array of canisters. To utilize the gravitational forces often a relatively large distance is provided between the canisters and the cavities to be filled. Given the distance the pharmaceutical travels in order to reach the cavity, often the pharmaceutical is traveling fast enough to cause the pharmaceutical to bounce when it hits the cavity. Sometimes the pharmaceutical bounces out of the intended cavity resulting in erroneous dosing.

The present invention provides an automated solid pharmaceutical packaging machine which overcomes the problems presented by previous packaging machines and which provides additional advantages over the prior art, such advantages will become clear upon a reading of the attached specification in combination with a study of the drawings.

SUMMARY OF THE INVENTION

Briefly, the present invention discloses an automated solid pharmaceutical packaging machine which provides storage locations for storing pharmaceutical dispensing mechanisms. A moveable robotic arm is capable of retrieving the dispensing mechanism from the storage locations and bringing the dispensing mechanisms to a filling location where solid pharmaceuticals are dispensed into a product package. A drive mechanism is provided to position the product package relative to the dispensing mechanism to fill the cavities of the product package.

In accordance with the preferred exemplary embodiment, the robotic arm is surrounded by a cylindrical wall housing a plurality of individual solid pharmaceutical dispensing canisters. The robotic arm grabs individual ones of the canisters and places one or more of the canisters in a drive mount for the canisters. Advantageously, a solid pharmaceutical product package having an array of cavities or a template have a similar array of cavities is located under the drive mount. A controller automatically positions the cavities under the dispensing canister to receive the pharmaceuticals dispensed therefrom.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
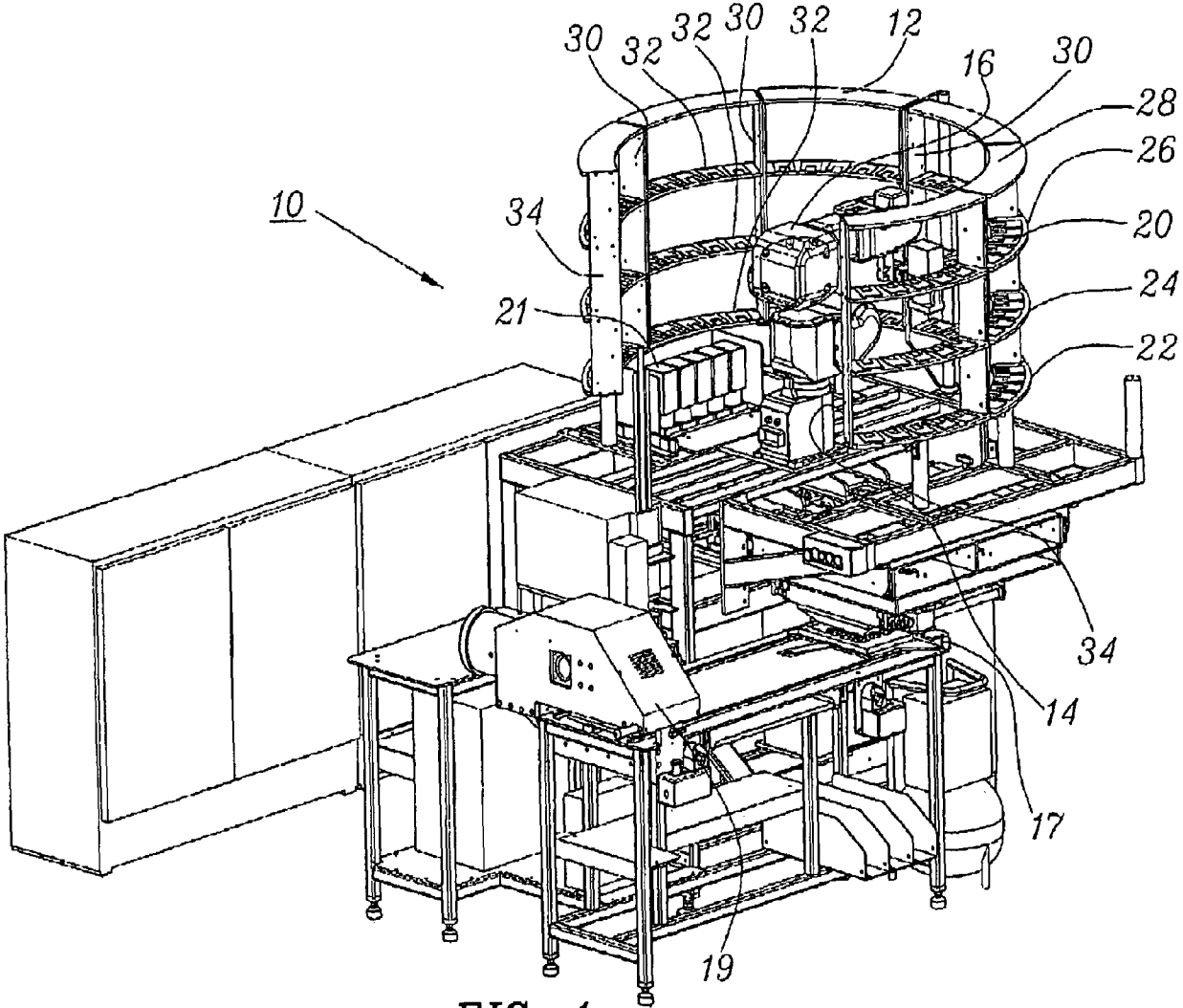
FIG. 1 is a perspective view of an embodiment of the automated solid pharmaceutical packaging machine of the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

An exemplary embodiment of the automated solid pharmaceutical product packaging machine 10 of the present invention is shown in FIG. 1. The machine 10 generally includes a storage frame 12, a filling station 14, a medication loading station 17, a sealing station 19, a robotic arm 16, and a replenishing station 21.

Figure 2:
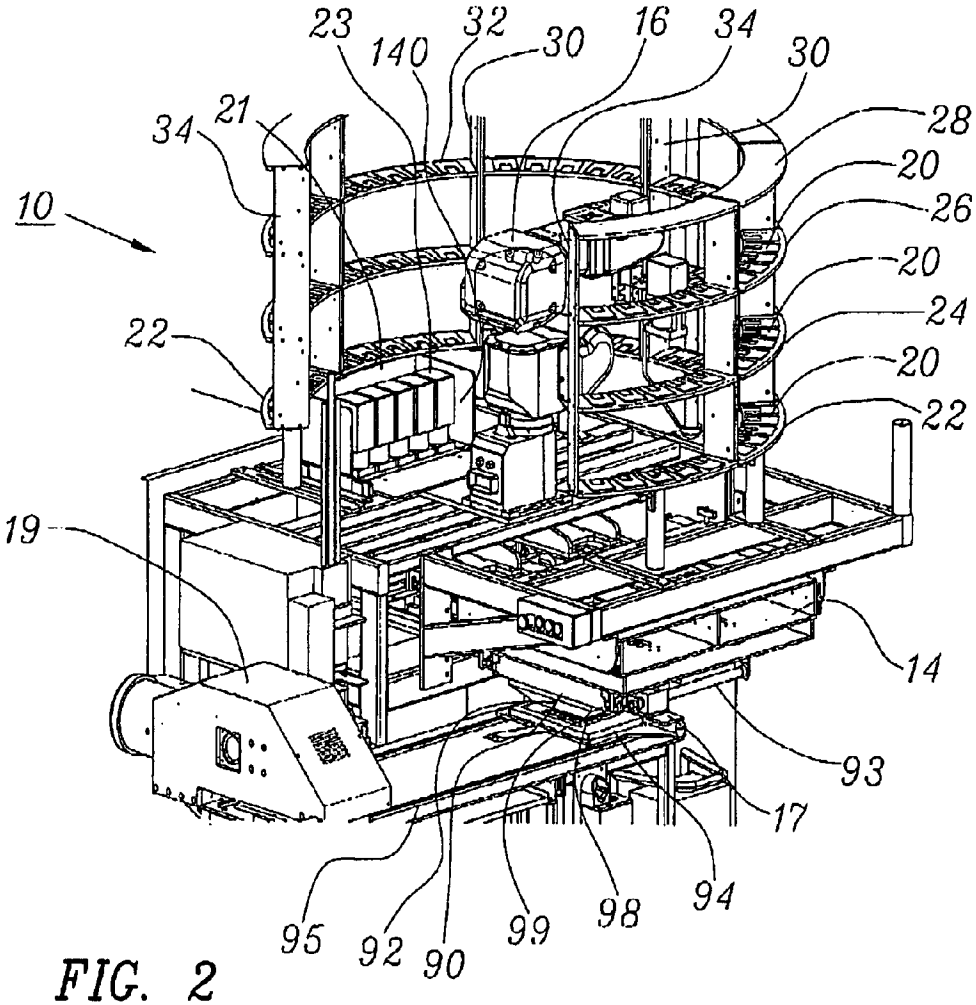
FIG. 2 is a detailed perspective view of a portion of the machine shown in FIG. 1.
Figure 4:
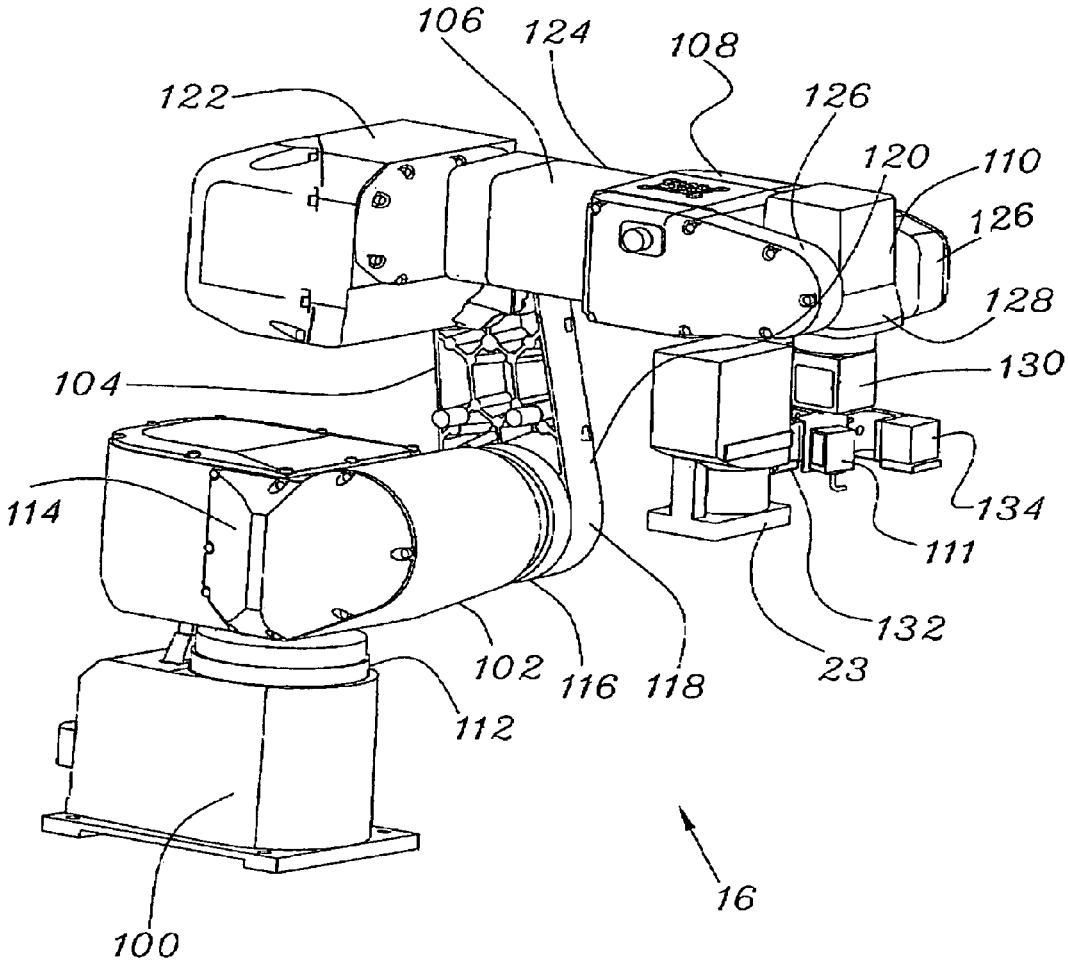
FIG. 4 is a perspective view of the robotic arm of the present invention used to transport pharmaceutical canisters shown supporting a single pharmaceutical canister.
Figure 5:
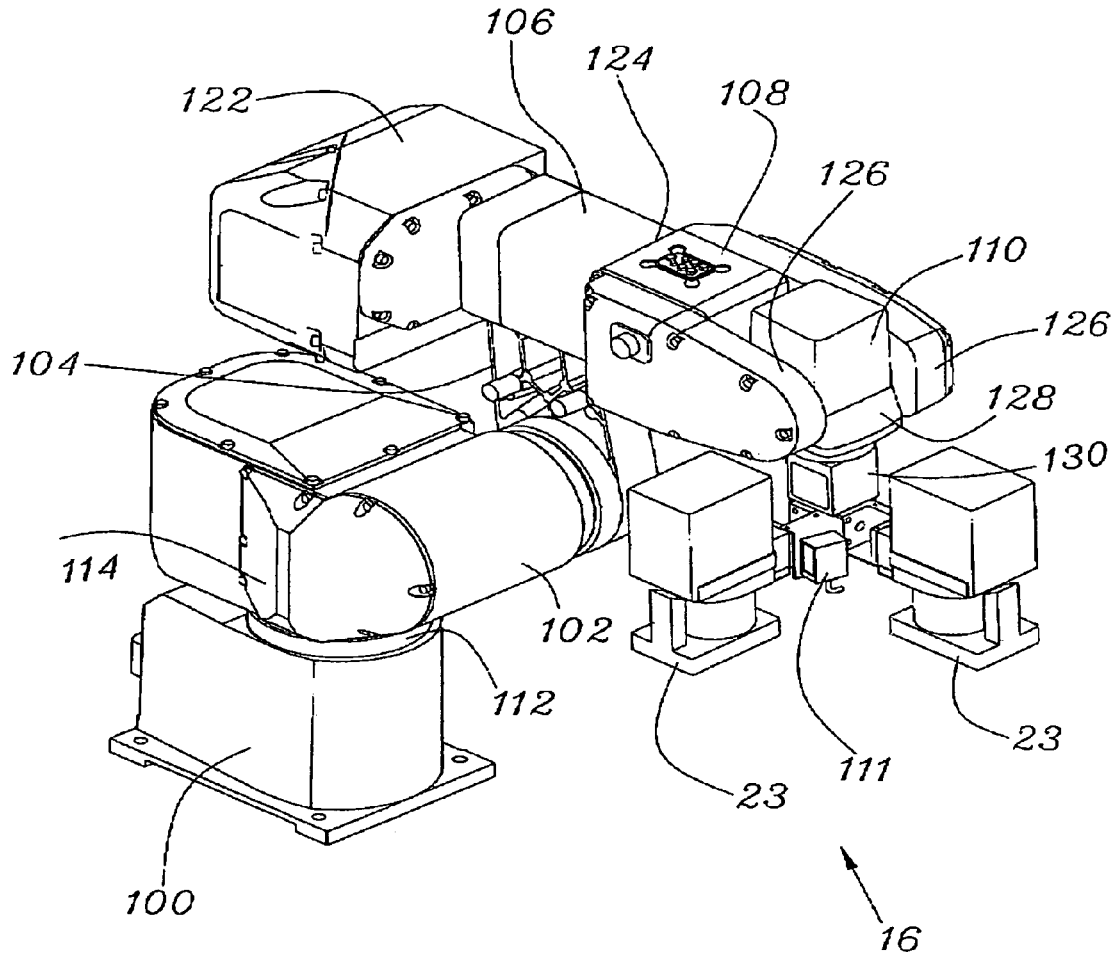
FIG. 5 is a perspective view of the robotic arm of the present invention used to transport pharmaceutical canisters shown supporting to pharmaceutical canisters.
Figure 6:
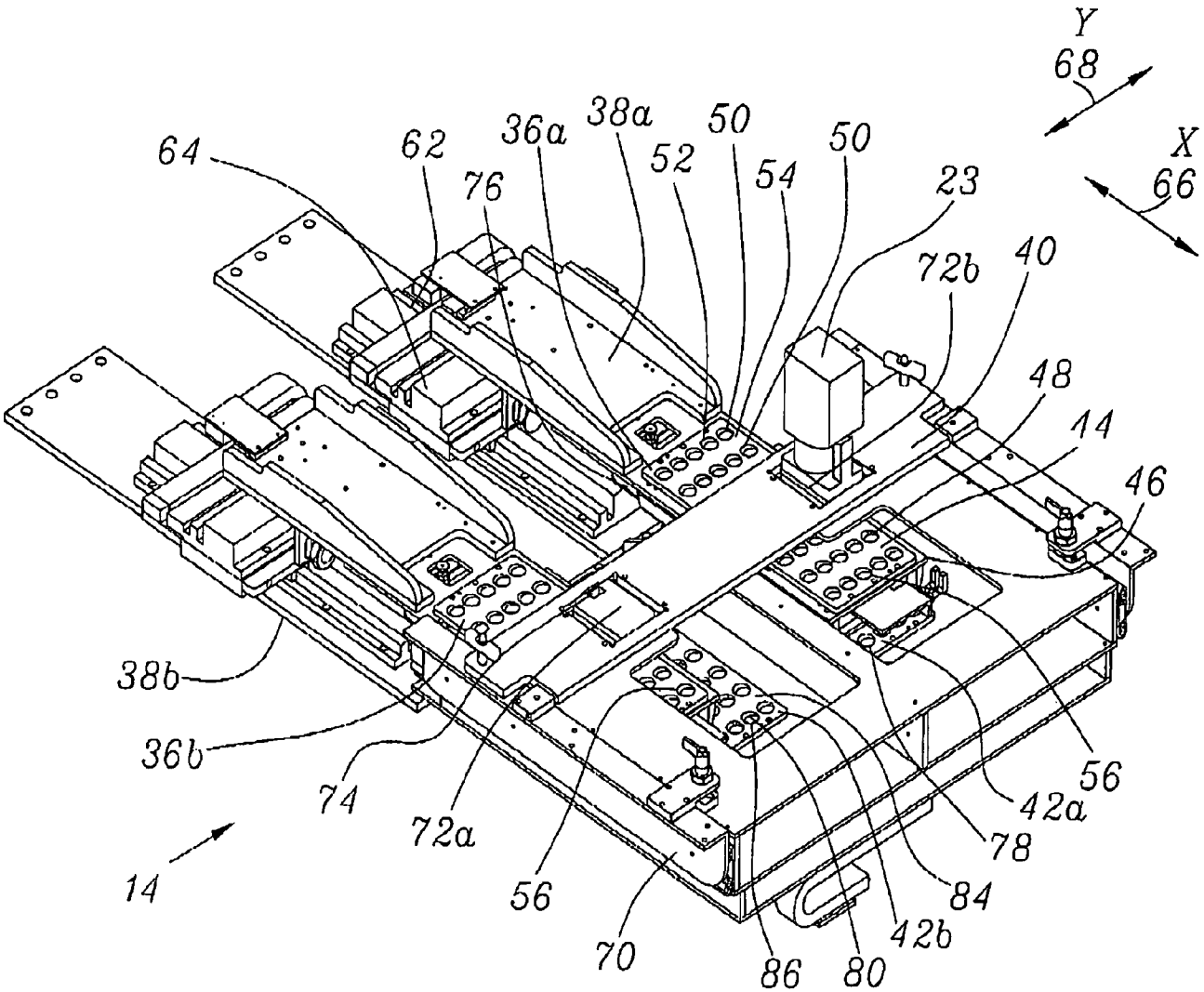
FIG. 6 is a perspective view of a portion of the machine of FIG. 1 which provides for filling of the pharmaceutical packaging.

As best shown in FIGS. 1 and 2, the storage frame 12 includes a plurality of storage locations 20 each designed to receive a pharmaceutical canister (See FIGS. 4–6). The storage frame 12 includes first 22, second 24, third 26 and fourth 28 arc-shaped horizontal frame members. The second horizontal frame member 24 is positioned above and spaced from the first horizontal frame member 22; the third horizontal frame member 26 is positioned above and spaced from the second horizontal frame member 24; and the fourth horizontal frame member 28 is positioned above and spaced from the third horizontal frame member 26. A number of vertical frame members 30 extend from the first horizontal frame 22 number to the fourth horizontal frame member 28. The first, second, and third horizontal frame members 22, 24, 26 provide a plurality of supports 32 identifying first, second, and third rows of pharmaceutical canister storage locations. Each horizontal frame member 22, 24, 26, 28 is arc-shaped to provide a generally cylindrically-shaped storage frame 12. A gap, however, is provided between the ends 34 of the arcs.

As best shown in FIG. 6, the filling station 14 generally includes first and second upper moveable templates 36*a*, 36*b*, first and second drive mechanism 38*a*, 38*b*, a canister mount 40, and first and second lower stationary templates 42*a*, 42*b*.

The first and second moveable upper templates 36*a*, 36*b* are identical and therefore only first moveable upper template 36*a* will be described. Each moveable template 36*a*, 36*b* includes an upper member 44 and a lower member 46. An array of apertures 48 is provided through the upper member 44. The array of apertures 48 includes a plurality of perpendicular rows 50 and columns 52. A gap 54 is provided between the rows 50 of apertures 48.

The lower member 46 also includes an array of apertures (not shown) arranges in a plurality of perpendicular rows and columns. A gap is provided between the rows of apertures through the lower member 46.

The upper member 44 is slidable relative to the lower member 46 from a first (filling) position to a second (dispensing) position. When the upper member 44 is in the first position as shown in FIG. 6, the apertures 48 of the upper member 44 are not aligned with the apertures of the lower member 46. Rather, in the first or filling position the apertures of the lower member 46 are positioned beneath the gaps 54 between the rows 50 of apertures 48 of the upper member 44. In this manner, cavities 56 are formed. The apertures 48 of the upper member 44 provide sidewalls of the cavities 56 and the gaps between the rows of apertures through the lower member 46 provide bottom walls of the cavities 56. When the upper member 44 is in the second position, the apertures 48 of the upper member 44 are aligned with the apertures of the lower member 46 to provide a passageway for pharmaceuticals as will be described herein. Each of the cavities 56 of the moveable template 36*a* is capable of holding a volume of solid pharmaceuticals necessary for patient dosing requirements.

The lower members 46 of the upper moveable templates 36*a*, 36*b* are attached to drive mechanism 38*a*, 38*b*. Drive mechanisms 38*a*, 38*b* are identical and therefore only drive mechanism 38*a* will be described. Drive mechanism 38*a* includes a first actuator 62 and a second actuator 64. The first actuator 62 provides for movement of the moveable template 36*a* in an X direction identified by arrow 66. The second actuator 64 provides for movement of the moveable template 36*a* in a Y direction identified by arrow 68. The X direction 66 is perpendicular to the Y direction 68. Those skilled in the art will appreciate that any type of drive may be utilized for effecting displacement of the templates 36*a*, 36*b*. Exemplary drives include electromagnetic drives, stepping motors, pneumatic drives, mechanical screw drives, or any other known displacement mechanisms.

The canister mount 40 is supported by a frame 70 and is positioned above the first and second moveable templates 36*a*, 36*b*. The canister mount 40 includes a first canister platform 72*a* and a second canister platform 72*b* spaced from the first canister platform 72*a*. The first canister platform 72*a* is positioned above the first moveable template 36*a* and the second canister platform 72*b* is positioned above the second moveable template 36*b*. Each canister platform 72*a*, 72*b* is identical. An aperture 74 is provided through each platform 72*a*, 72*b* through which the pharmaceuticals dispensed from the canisters 23 will pass.

The first and second stationary templates 42*a*, 42*b* are positioned beneath the first and second moveable templates 36*a*, 36*b*. The first and second stationary templates 42*a*, 42*b* are identical to each other and therefore only the first stationary template 42*a* will be described. The stationary template 42*a* includes an upper member 74 and a lower member 76. An array of apertures 78 is provided through the upper member 74. The array of apertures 78 includes a plurality of perpendicular rows 80 and columns 82. A gap 84 is provided between the rows 80 of apertures 78.

The lower member 76 also includes an array of apertures (not shown) arranged in a plurality of perpendicular rows and columns. A gap is provided between the rows of apertures through the lower member 76.

The upper member 74 is slidable relative to the lower member 76 from a first (filling) position to a second (dispensing) position. When the upper member 74 is in the first position as shown in FIG. 6, the apertures 78 of the upper member 74 are not aligned with the apertures of the lower member 76. Rather in the first or filling position, the apertures of the lower member 76 are positioned beneath the gaps 84 between the rows 80 of apertures 78 of the upper member 74. In this manner, cavities 86 are formed. The apertures 78 of the upper member 74 provide sidewalls of the cavities 86 and the gaps between the rows of apertures through the lower member 76 provide bottom walls of the cavities 86. When the upper member 74 is in the second position, the apertures 78 of the upper member 74 are aligned with the apertures of the lower member 76 to provide a passageway for pharmaceuticals as will be described herein. Each of the cavities 76 of the stationary template 42*a* is capable of holding a volume of solid pharmaceuticals necessary for patient dosing requirements.

The medication loading station 17 includes a slidable tray 90, a transfer cartridge 92 attached to the slidable tray 90, and a package platform 94.

The slidable tray 90 includes a plurality of apertures aligned with the cavities 86 of the stationary templates 42*a*, 42*b*. The slidable tray 90 is mounted to a track 93 for positioning the tray 90 under either the first stationary template 42*a* or the second stationary template 42*b*.

The transfer cartridge 92 includes a plurality of passageways defined by sidewalls having upper ends and lower ends. The upper ends of the sidewalls define upper ends of the passageways and lower ends of the sidewalls define lower ends of the passageways. The upper ends of the passageways are aligned with the apertures of the tray 90 and the lower ends of the passageways are aligned with the cavities of the product package to be filled.

The package platform 94 is mounted to a track 95 which allows the package platform 94 to be positioned under the transfer cartridge 92 and to be positioned at the sealing station 19. The package platform 94 receives the product package 98 to be filled. The product package 98 includes a plurality of cavities 99.

The robotic arm 16 is best shown in FIGS. 4 and 5. The robotic arm 16 includes a stationary support 100, a first member 102, a second member 104, a third member 106, a hand 108, a tool changing mechanism 110, and a barcode reader 111. The stationary support 100 is positioned within the arc provided by the storage frame 12. The stationary support 100 includes an upper end 112. The first member 102 extends generally horizontally from the upper end 112 of the stationary support 100. The first member 102 includes a first end 114 and a second end 116. The first member 102 is mounted proximate its first end 114 to the stationary support 100. A first axis is provided between the stationary support 100 and the first member 102 to allow for rotation of the first member 102 relative to the stationary support 100. The second member 104 extends generally vertically from the second end 116 of the first member 102. The second member 104 includes a first end 118 and a second end 120. A second axis is provided between the first member 102 and the second member 104 to allow for rotation of the second member 104 relative to the first member 102. The third member 106 includes a first end 122 and a second end 124. The third member 106 is connected to the second end 120 of the second member 104 at a location between the first and second ends 122, 124 of the third member 106. A third axis of rotation is provided between the second member 104 and the third member 106 to allow for rotation of the third member 106 relative to the second member 104. The hand 108 extends from the second end 124 of third member 106. First and second fingers 126 extend from the hand 108. The tool changing mechanism 110 is supported between the first and second fingers 126. The tool changing mechanism 110 includes a head portion 128, a body portion 130, a first canister support 132, and a second canister support 134. The head portion 128 of the tool changing mechanism 128 is supported between the first and second fingers 126 of the hand 108. The body 130 extends downwardly from the head portion 128 and is capable of rotation relative to the head portion 128. The first and second canister supports 132, 134 extend outwardly from the body 130. A ninety degree angle is provided between the first and second canister support 132, 134.

The bar code reader 111 is mounted from the body 130 of the tool changing mechanism 110. A computer (not shown) is provided in connection with the packaging machine 10 to provide instructions regarding the pharmaceuticals to be packaged. Specifically the computer provides instructions regarding which pharmaceuticals are to be placed in each of the cavities of the packages upper moveable template 36*a*, 36*b*.

The pharmaceutical dispensing canisters 23 are commercially available. Each canister 23 is capable of selectively dispensing a pre-designated number of solid pharmaceutical products. Prior to operation of the packaging machine 10, the pre-filled canisters 23 are loaded in the storage locations 20 of the storage frame 12. Each pharmaceutical canister 23 may contain a different type of solid pharmaceutical.

Figure 3:
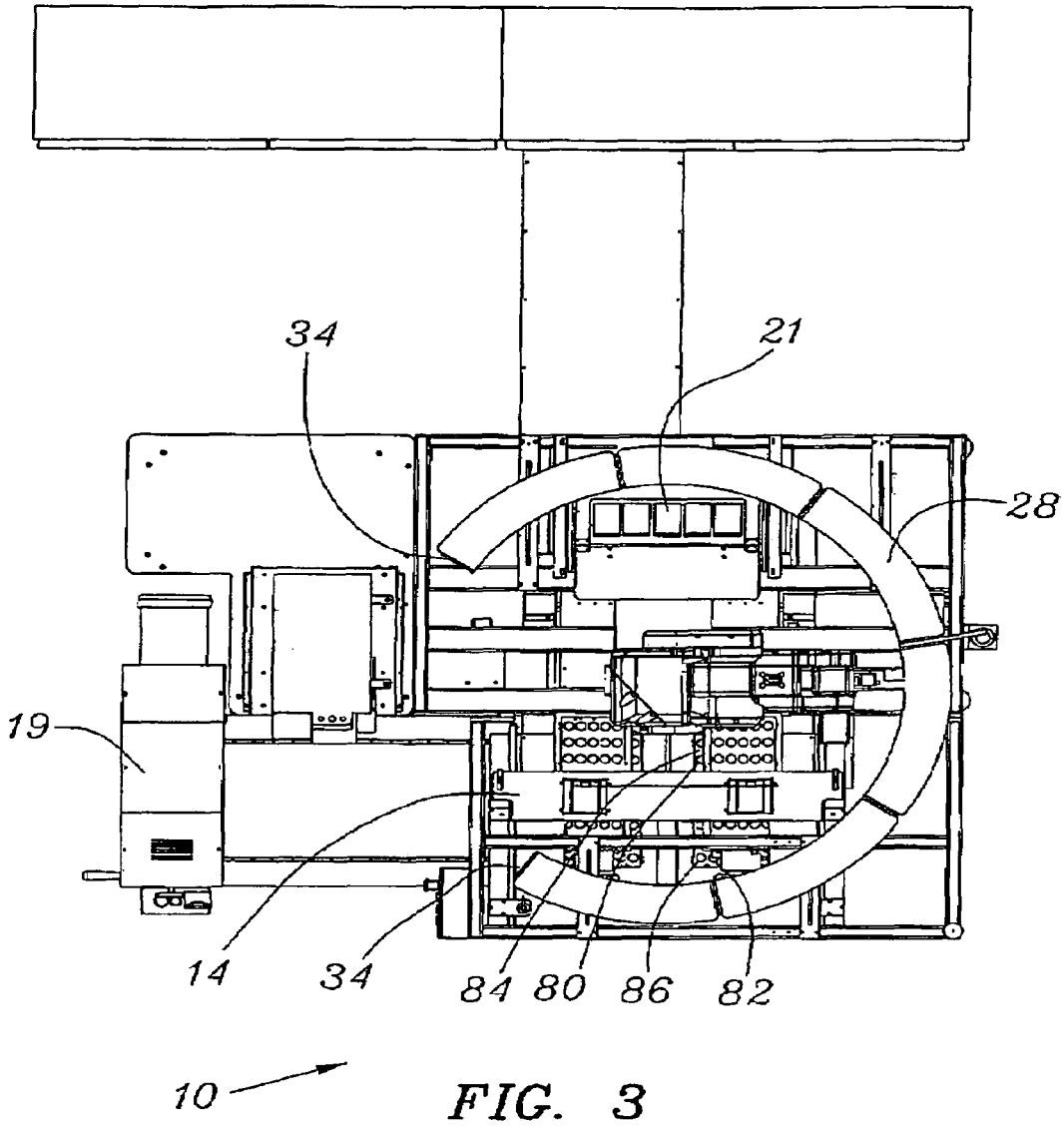
FIG. 3 is a to plan view of the machine shown in FIG. 1.

The replenishing station 21 includes tray 140 having a plurality of storage locations for receiving a number of canisters 23. As shown in FIGS. 1–3, the tray 140 includes five storage locations and a canisters 23 is positioned in each location. The tray 140 is positioned below the horizontal member 22 of the frame 12 proximate an end 34 thereof. Access to the storage locations of the tray 140 is provided to an operator standing outside of the frame 12.

Operation of the packaging machine 10 begins by loading canisters of pharmaceuticals to be dispensed into the storage locations 20 of the frame 12. Information regarding the storage location 20 of each of the pharmaceuticals to be dispensed is provided to the computer controller. Information regarding the medication to be dispensed into the product package 98 is also provided to the computer controller.

Next a product package 98 to be filled is selected an mounted in the package platform 94. Upon selection of the product package 98 to be filled, a transfer cartridge 92 to be mounted to the slidable tray 90 of the medication loading station 17 is selected. The transfer cartridge 92 selected provides passageways having lower ends which align with the cavities 99 of the product package 98. For instance, the cavities 99 of the product package 98 are provided in an array having a plurality of closely spaced rows and columns. As described above, the moveable templates 36*a*, 36*b* include gaps 54 between the rows of apertures 48. Likewise the stationary templates 42*a*, 42*b* include gaps 84 between the rows of apertures 78. The gaps 54, 84 of the templates 36, 42 allow for the sliding action of the upper and lower members of the templates 36, 42 as described above. As best shown in FIG. 2 the rows of cavities 99 of the package 98 are closely spaced. Thus, the sidewalls of the passageways of the transfer cartridge 92 are angled to provide alignment between the cavities of the templates 42*a*, 42*b* and the cavities 99 of the product package 98. The transfer cartridge allows for transfer of the pharmaceuticals into a variety of packages. Once the appropriate transfer cartridge is selected the transfer cartridge is mounted to the slidable tray 90.

Next the computer controller provides instructions to the robotic arm 16 to retrieve a first pharmaceutical dispenser 23 from a first location 20. The first, second and third members 102, 104, 106 and the had 108 of the robotic arm 16 are rotated about the axes, to provide alignment of the tool changing mechanism 110 mounted to the hand 108 with the canister 23 to be retrieved. The bar code reader of the robotic arm 16 reads a bar code label on the canister 23 to ensure the appropriate canister has been retrieved. Next, the canister support 132, 134 is then engaged with a canister 23 and the canister 23 is retrieved. The robotic arm 16 is again rotated about its axes to position the canister 23 on one of the canister platforms 72*a*, 72*b* of the canister mount 40 at the filling station 14. After positioning the canister 23 on the canister platform 72*a*, for example, instructions are provided to the drive mechanism 38*a* to position the appropriate cavity 56 of the moveable template 36*a* beneath the aperture 74 of the canister platform 72*a*. The pharmaceuticals are then dispensed from the canister 23 and pass through the aperture 74 of the canister platform 72*a* into the aligned cavity 56. Instructions are then provided to the drive mechanism 38*a* to move the upper template 36*a* relative to the aperture 74 of the canister platform 72*a* to align another cavity 56 with the aperture 74. The drive mechanism 38*a* provides movement of the upper template 36*a* along the first and second actuators 62, 64 to provide movement of the upper template 36*a* in the X and Y directions. In accordance with the instructions provided to the drive mechanism 38*a*, some or all of the cavities 56 may be filled. In addition, one or more pharmaceuticals from the canister 23 may be provided in each cavity 56. Once each of the appropriate cavities 56 has been filled with the pharmaceutical provided in the canister 23, the canister 23 is retrieved by the robotic arm 16 and returned to its appropriate storage location 20. A second canister 23 is then retrieved by the robotic arm 16 and positioned on the platform 74*a* of the canister mount 40. Instructions are again provided to the drive mechanism 38*a* to move the upper template 36*a* relative to the aperture 74 and fill the appropriate cavities 56 of the upper template 36*a*. Once the appropriate cavities 56 are filled, the robotic arm 16 retrieves the canister 23 from the platform 74*a* and returns the canister 23 to its appropriate storage location 20. The process of retrieving canisters 23 from storage locations 20, placing the canisters 23 on the platform 74*a*, dispensing the pharmaceuticals into the template cavities 56 and returning the canister 23 to the storage location 20 can be repeated as many times as necessary to provide the required pharmaceuticals in the template cavities 56.

As shown in FIG. 6, the pharmaceuticals travel by gravitational force from the canister 23 to the template 36*a*, however, because the robotic arm 16 places the canister 23 on the canister mount 40, the distance which the pharmaceuticals must travel is relatively short. Therefore, the speed at which the pharmaceutical is traveling when it contacts the template 36*a* is relatively low and the problem with pharmaceuticals bouncing out of the template cavities 56 is avoided.

As described above the cavities 56 of the template 36*a* correspond with the cavities 86 of the lower stationary template 42*a*. Once the template 36*a* has been filled, the template 36*a* is positioned over the stationary template 42*a* and the upper member 44 of the template 36*a* is slid to align the apertures 48 of the upper member 4*r* with the apertures of the lower member 46 so as to allow the pharmaceuticals provided in the cavities 56 of the template 36*a* to fall into the aligned cavities 86 of the stationary template 42*a*.

Next the slidable tray 90 along with the transfer cartridge 92 is positioned on the track 93 such that the apertures of the slidable tray 90 are aligned with the cavities 86 of the stationary template 42*a*. Upon alignment, the upper member 74 of the stationary template 42*a* is slid relative to the lower member 76 of the stationary template 42*a* such that the apertures 78 the upper member 74 are aligned with the apertures of the lower member 76 allowing the pharmaceuticals within the cavities 86 of the template 42*a* to fall through the apertures of the tray 90 and into the passageways of the transfer cartridge 92.

The tray 90 and transfer cartridge 92 are then slid along the track 93 to position the transfer cartridge over the product package 98 and the pharmaceuticals within the transfer cartridge are dispensed into the product package 98.

The filled package 98 is then inspected and moved along the track 95 to the sealing station 19 wherein a sealing member is adhesively applied to the package 98 to seal the pharmaceuticals within the package 98. Subsequent to sealing, the package 98 may be provided to a printing station wherein information such as, for example, the name of the patient, the name of the pharmaceutical, the dates and times prescribed for the patient to take the pharmaceutical, the expiration date of the pharmaceutical, etc. can be printed on the package.

When a canister 23 is empty, the robotic arm 16 places the canister 23 in the tray 140 of the replenishing station 21. An operator can then remove the empty canister 23 from the tray 140 and places a new canister on the tray 140. The robotic arm 16 can then retrieve the new canister 23 from the replenishing station 21 and transfers the canister 23 to specified location 20 of the frame 12. Different types of pharmaceuticals can be supplied to the frame 20 through the replenishing station 21.

It is to be understood that each of the moveable templates 36*a*, 36*b* can be filled simultaneously but independently. Because a separate drive mechanism 38*a*, 38*b* is provided for template 36*a*, 36*b*, different instructions can be provided to the drive mechanisms 38*a*, 38*b* to fill the templates 36*a*, 36*b*. In addition, as shown in FIG. 5, if desired, the robotic arm 16 is capable of retrieving and transporting two pharmaceutical dispensers 23 at the same time. By providing transfer of the pharmaceuticals from the moveable templates 36*a*, 36*b* to the stationary templates 42*a*, 42*b*, refilling of the moveable templates 36*a*, 36*b* can begin immediately upon dispensing the pharmaceuticals from the moveable templates 36*a*, 36*b* to the stationary templates 42*a*, 42*b*.

It is also to be understood that two or more canisters 23 could be used to fill a single product package. For example, the canister mount 40 could be altered to include first and second canister platforms 72 spaced apart such that the first and second canisters dispensed pharmaceuticals into alternating rows of the template 36*a*. Alternatively, the canister mount 40 could be altered to include first and second canister platforms spaced apart such that the canisters dispensed pharmaceuticals into left and right sides of the template 36*a*.

Although operation of the invention has been described by first filling templates 36*a*, 36*b*, 42*a*, 42*b* and then filling a package 98 by positioning the package 98 under the templates, it is to be understood that use of the templates 36*a*, 36*b*, 42*a*, 42*b* is not required. In the event templates are not used, a package 98 is supported by the drive mechanism 38*a* and positioned under the apertures 74 of the canister platforms. Pharmaceuticals would then be dispensed directly from the canisters 23 to the package 98. Once the package 98 is filled, the package 98 would be provided directly to the sealing station 19.

Although operation of the invention has been described by moving the template 36*a*, 36*b* or the package 98 relative to the aperture 74 of the canister platform 72*a*, 72*b*, it is to be understood that relative positioning of the aperture 74 and the template 36 or package 98 could be achieved by moving the canister platform 72*a*, 72*b*. In the event the canister platform 72*a*, 72*b* were to be moved, the platforms 72*a*, 72*b* would need to be independently supported to provided independent movement of each platform.

While a preferred embodiment of the present invention is shown and described, it is envisioned that those skilled in the art may devise various modifications of the present invention without departing from the spirit and scope of the appended claims.

The invention claimed is:

1. A machine for packaging solid pharmaceuticals comprising:

a plurality of storage locations for storing a plurality of pharmaceutical dispensing mechanisms containing a plurality of solid pharmaceuticals therein;

a filling location spaced from said dispensing mechanisms;

a robotic arm capable of retrieving at least one of said plurality of dispensing mechanism from said storage location to said filling location and capable of returning said at least one of said plurality of dispensing mechanisms to said storage location;

a drive mechanism for positioning a product package having a plurality of cavities in order to position each of said cavities beneath said filling location; and wherein when said dispensing mechanism is positioned at said filling location, pharmaceuticals are dispensed from said dispensing mechanism into said cavities.

2. A machine as defined in claim 1, wherein said plurality of storage locations are arranged along an arc.

3. A machine as defined in claim 1, wherein said plurality of storage locations are arranged vertically.

4. A machine as defined in claim 1, further comprising a drive mount at said filling location and wherein said dispensing mechanism is positioned on said drive mount for dispensing said pharmaceuticals.

5. A machine as defined in claim 1, wherein said plurality of cavities are positioned in an array and said drive mechanism provides movement of said product package in a X direction and a Y direction.

6. A machine as defined in claim 1, further comprising a template having a plurality of cavities aligned with said cavities of said package, said template positioned beneath said dispensing mechansim; and;

wherein said pharmaceuticals are dispensed from said dispensing mechanism into said cavities of said template prior to said pharmaceuticals being dispensed to said cavities of said package.

7. A machine as defined in claim 1, wherein said machine includes a first drive mechanism for positioning a first product package and a second drive mechanism for simultaneously positioning a second product package.

8. A machines as defined in claim 1, wherein upon dispensing said pharmaceuticals from said dispensing mechanism, the distance between said dispensing mechanism and said cavities to be filled is minimized.

9. A method of packaging solid pharmaceuticals comprising:

providing a plurality pharmaceutical dispensing mechanisms containing a plurality of pharmaceuticals at a plurality of storage locations;

providing a product package having a plurality of cavities therein at a filling location, said filling location being spaced from said storage locations;

providing a drive mechanism to provide alignment between said product package cavities and said filling location;

providing a robotic arm;

utilizing said robotic arm to retrieve one of said dispensing mechanism;

transporting said retrieved dispensing mechanism to said filling location;

aligning said product package cavities and said retrieved dispensing mechanism; and dispensing pharmaceuticals from said dispensing mechanism into said cavities of said product package.

10. A method as defined in claim 9, wherein said step of aligning is provided by moving said product package.

11. A method as defined in claim 9, wherein said step of aligning is provided by moving said retrieved dispensing mechanism.

* * * * *